US005830040A

United States Patent [19]

Morgan et al.

[11] Patent Number: 5,830,040

[45] Date of Patent: Nov. 3, 1998

[54] CUSHION TIPS FOR BRASSIERE FRAMES

[75] Inventors: Harvey S. Morgan, Woodmere; Joseph Horta, Yonkers, both of N.Y.

[73] Assignee: S&S Industries, Inc., New York, N.Y.

[21] Appl. No.: 524,518

[22] Filed: Sep. 7, 1995

[51] Int. Cl.[6] ..... A41C 3/12; A41C 3/14; A41D 27/06

[52] U.S. Cl. ..... 450/41; 450/93; 2/255; 2/256; 2/257; 2/259; 2/260; 2/261

[58] Field of Search ..... 450/41, 42, 43, 450/44, 45, 46, 47, 48, 49, 50, 51, 52, 53; 2/255, 256, 257, 258, 259, 260, 261, 262, 263, 264, 260.1

[56] References Cited

U.S. PATENT DOCUMENTS

| | | | |
|---|---|---|---|
| 3,605,753 | 9/1971 | Schwartz | 450/52 |
| 3,747,606 | 7/1973 | Tareau | 450/48 |
| 3,777,763 | 12/1973 | Schwartz | 450/52 |
| 3,799,175 | 3/1974 | Rowell | 450/52 |
| 4,133,316 | 1/1979 | Schwartz | 450/52 |
| 4,271,580 | 6/1981 | King et al. | 450/52 |

*Primary Examiner*—Jeanette E. Chapman
*Attorney, Agent, or Firm*—Abelman, Frayne & Schwab

[57] ABSTRACT

A cushion tip for a brassiere frame is molded in-situ about an end of the brassiere frame that has been reduced in transverse cross-section at its end, whereby the cushion tip provides a continuation of the outer surfaces of the brassiere frame in at least the dimension of the thickness of the frame, and also, optionally, in the direction of the width of the frame.

10 Claims, 1 Drawing Sheet

CUSHION TIPS FOR BRASSIERE FRAMES

FIELD OF THE INVENTION

This invention relates to tips for brassiere frames, the tips providing a cushioning effect on the ends of the brassiere frame to which the tips are attached.

BACKGROUND OF THE INVENTION

It is commonly known in the art to dip the ends of brassiere frames into molten or uncured plastics material in order to provide a gob of plastics material surrounding the surrounding ends of the brassiere frame.

That approach, however, has the disadvantage that firstly the plastics material hardens after its application to the tip, thus providing a source of discomfort to the ultimate wearer of the garment incorporating the brassiere frame, and secondly, that it increases wear on the garment fabric at the enlarged ends of the brassiere frame.

Further, the commonly adopted dipping technique results in an increase in the transverse cross-section of the frame, this in turn requiring a larger pocket to be provided in the garment into which the frame is inserted, and, in turn, resulting in looseness of the frame within the pocket at positions intermediate the ends thereof. This results in an increase in wear on the fabric providing the pocket due to movement of the uncoated portion of the frame within the pocket relative to the surrounding fabric.

Alternate methods of providing tips on brassiere frames, are described in U.S. Pat. Nos. 3,599,643, Schwartz, issued Aug. 17, 1991, 3,799,175, Rowell, issued Mar. 26, 1974, 4,133,316, Schwartz, issued Jan. 9, 1979, 4,306,565, Rowell, issued Dec. 22, 1981, and 4,777,668, Weston, issued Oct. 18, 1988.

Each of these patents teach the fitting of a pre-molded plastics tip onto the respective ends of the frames subsequent to the manufacture of the frames and the tips as entirely separate items.

While the tips can be applied to the ends of the frames by automated machinery, this represents added costs in the manufacture of the frames.

More importantly, the pre-molding of the tips from soft plastics material, and their subsequent installation on the ends of the frames, requires that the width of the tips be greater than the width of the frame, in order to provide sufficient strength in the tip to permit forcible passage of the tip onto frame, or, in the alternative to permit passage into the tip of a barb or other securing member provided at the end of the frame.

As the width of the tip is of necessity greater than the width of the frame, this in turn requires that the width of the pocket in the garment be correspondingly increased in order to accept the frame tip, with the disadvantage then occurring of scuffing of the fabric of the pocket by the edges of the frame at all positions intermediate the respective tips.

The industry prefers that the size of the pocket in the garment be minimalized to the greatest possible extent, and preferably, to an extent such that insertion of the brassiere frame is permitted by the inherent stretch in the fabric forming the pocket, as opposed to the pocket being formed oversized to accommodate passage therethrough of the tip of the frame.

A significant advantage of pre-molded tips is that a relatively soft and pliable plastics material that can be employed which provides a cushioning effect at the free end of the tip. Thus, the tip can be made readily flexible in directions perpendicular to the width of the frame, and additionally can present limited flexibility in the direction of the width of the frame.

OBJECT OF THE INVENTION

It is an object of this invention to provide a cushion tip for a brassiere frame that is of lesser width than known cushion tips, thus facilitating easy passage of the frame and its tip into a frame receiving pocket of the garment.

It is also contemplated that the thickness of the tip also is of lesser thickness than the thickness of known cushion tips.

In the event that the width of the tip is no more than the width of the frame, then, the pocket in the garment can be decreased in size to the extent that the fabric of the pocket is stretched over the tip and also over the frame during insertion of the tipped frame into the garment.

In the event that the fabric has give or stretch, the frame and its tip are then held in the pocket in a manner militating against movement of the frame and tip within the pocket, the frame and its tip being held in the pocket under a compressive force provided by the tension developed by stretching of the fabric comprising the pocket.

SUMMARY OF THE INVENTION

According to the present invention, the respective ends of the frame are stamped or punched such that the end of the frame that is to be enshrouded by a cushion tip is of less width than the width of the remainder of the frame, and, optionally, of less thickness than the thickness of the frame.

The cushion tip is then applied to the ends of the frame by injection molding techniques, the molded tip having a width no greater than the width of the frame, and, optionally having a thickness that is no greater than the thickness of the frame.

DESCRIPTION OF THE DRAWINGS

Preferred embodiments of the invention will now be described with reference to the accompanying drawings, in which.

DESCRIPTION OF THE PRIOR ART

Figure 1:
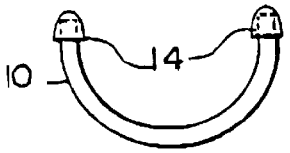
FIGS. 1 and 2 illustrate typical single and double brassiere frames.
Figure 2:
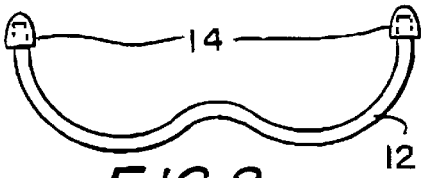

FIGS. 1 and 2 illustrate typical shapes of brassiere frames, which either can be a single frame 10 as illustrated in FIG. 1, or, a double frame 12 as illustrated in FIG. 2, the frames of both FIGS. 1 and 2 being provided with cushion tips 14 at their respective ends, the provision of such cushion tips being well known in the art and described in the prior patents referred to above.

According to the prior art teachings, the tips 14 are manufactured separately from the frames 10 or 12, and, subsequently are applied to the ends of the frames 10 or 12 by pushing the tips onto the exposed ends of the frames.

However, pushing of the tips onto the ends of the frames, which can be effected by mechanical means, in turn requires that the tips themselves be of sufficient size and strength to withstand rupturing, tearing, or ripping, such as can occur when the end of the frame is inserted into the tip.

The tip itself is made of a relatively soft plastics material having only minor strength and relatively low resistance to tearing, ripping, or otherwise rupturing during the relatively high speed mechanical handling of the tips as they are forced onto the ends of the frames.

As structural failure of isolated ones of the tips can be expected during the mechanical forcing of the tips onto the frame ends, then, ancillary equipment is required in order to remove damaged or otherwise faulty tips, of which there are two on each frame, and, disposal not only of the frame, but also of the remaining undamaged tip.

Figure 3:
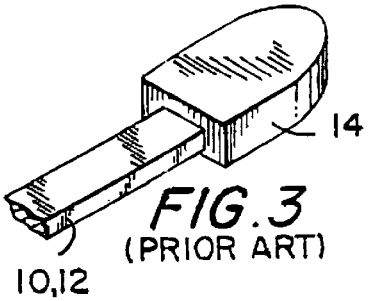
FIG. 3 (PRIOR ART)
FIG. 3 illustrates a prior art cushion tip applied to the end of a brassiere frame.

For this reason, and as illustrated in FIG. 3, push-in tips for brassiere frames have been made of relatively massive construction, the tip 14 being of considerably greater width than the frame 10 or 12, and, the thickness of the tip also being considerably in excess of the thickness of the frame 10 or 12.

Not only does this relatively massive construction of the tip increase the costs of the plastics material employed in the manufacture of the tips, and also decrease the rapidity with which the tips can be molded and then cooled to handling temperature, but also, the tips when installed on the brassiere frames in turn require that the receiving pocket in the garment be of sufficient size to accept the tips, which in turn means that the pocket in the garment must be considerably oversized as related to the cross-section of the frame 10 or 12.

The preference of the industry is that the pockets be made as small and inconspicuous as is possible, and, that the fabric of the pockets be smooth and free of ruckling, in order to increase the aesthetic appearance of the finished garment, and enhance consumer acceptance of that garment.

The only manner of providing a tight fit of the pocket around the frame according to the prior art teachings is to resort to a subsequent heat-setting or shrinkage of the fabric subsequent to insertion of the frame. Some fabrics, however, are not subject to shrinkage other than by the expensive procedure of auto-claving.

Brassiere garments are produced in very large quantities. Thus, any cost saving that can be accomplished in the manufacture of the garment is of far-reaching consequence to the industry, as is the finished appearance of the garment.

DESCRIPTION OF THE PREFERRED EMBODIMENTS

FIGS. 4 through 7 illustrate preferred embodiments of the invention, each of those Figs. being to larger scale than the illustration in FIG. 3. In each instance in FIGS. 4 through 7 the frame 10 or 12 will be no larger than the frame 10 or 12 illustrated in FIG. 3. As shown in FIG. 3, the brassiere frame includes a length of metal of a first predetermined cross-section, having a cross-sectional area defined by its width w multiplied by its thickness t.

Figure 4:
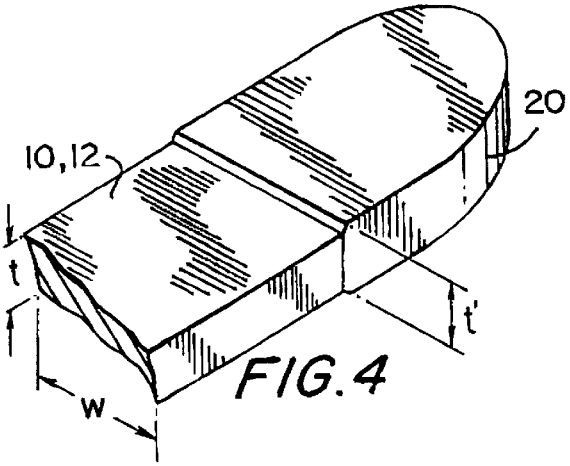
FIG. 4 illustrates a cushion tip according to the present invention applied to an end of a brassiere frame.
Figure 5:
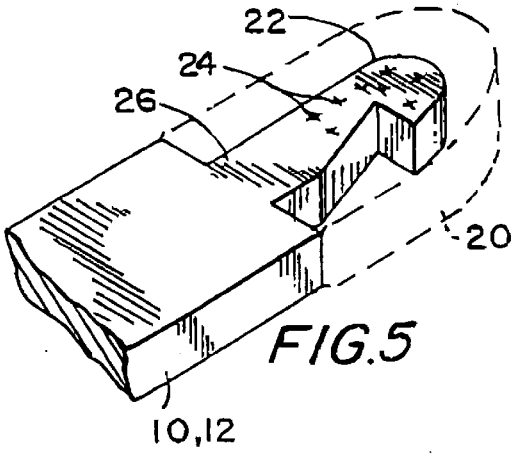
FIG. 5 is a view illustrating a preferred shape of the end of the brassiere frame.
Figure 6:
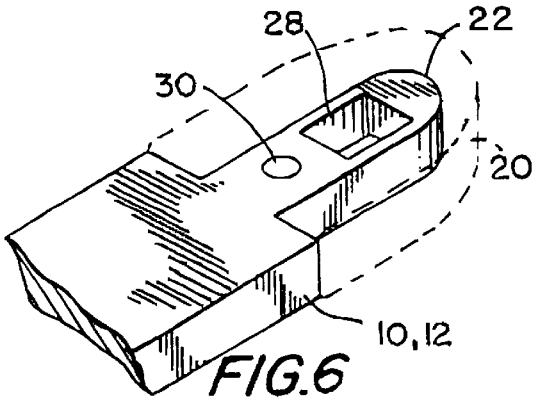
FIG. 6 is a view corresponding with FIG. 5, and showing an alternative construction of the end of the brassiere frame, and, FIG. 7 is a further preferred construction of the end of a brassiere frame.
Figure 7:
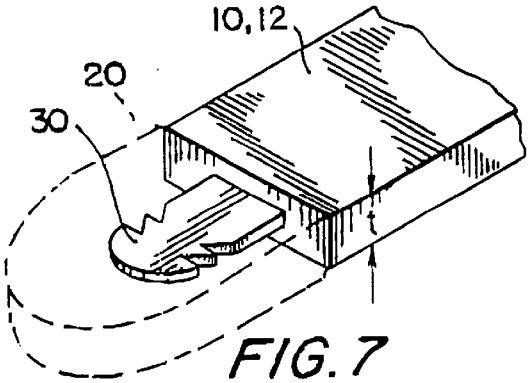

The significant difference in FIGS. 4 through 7 is that the cushion tip 20 shown in full lines in FIG. 4 and in dotted lines in FIGS. 5, 6 and 7 is of no greater width than the width of the frame 10 or 12 itself.

The tip 20 in the embodiments of FIGS. 4, 5, and 6 will be slightly greater in thickness as shown by t' of FIG. 4, than the thickness t of the frame 10 or 12, in order to provide a retaining skin on the width of the opposite faces of the frames 10 and 12. That skin can be self-adherent to the flat surfaces of the width of the frame in order to fixedly secure the tip to the frame.

In FIG. 7, the tip 20 not only is of the same width as the width of the frame 10 or 12, but also, is of the same thickness t as the thickness of the frame 10 or 12.

In this manner, cushion tips are provided on brassiere frames that constitute a minimal enlargement of the thickness only of the brassiere frame, or, cushion tips that are no greater in cross-sectional dimensions than the cross-section of the associated frame.

So constructing the tipped brassiere frames permits a reduction in the size of the pocket in the garment into which the frame is to be inserted, and in turn, either reduces or eliminates the problems with prior art frames that previously have been discussed.

Instead of the cushion tips having been pre-molded, and subsequently positioned over the ends of the frames, as taught in the prior art, the cushion tips 20 are molded in-situ directly onto the ends of the frames, the plastics material employed preferably being one that has an adhesive affinity to the metal of the frame, thus to provide a cushion tip that is structurally bonded to the associated frame, as opposed to being a frictional or interference fit thereon.

Bonding of the cushion tips to the frames carries with it the further beneficial effect that the tips cannot be accidentally removed from the ends of the frames during wearing of the garment or laundering of the garment, such an occurrence being a common one with the prior art cushion tips. Once the prior art cushion tip has been dislodged from its supporting frame end, it can then only be replaced on the frame end with extreme difficulty involving exceptional manual dexterity, with the additional problem that if the prior art cushion tip has been forcibly removed from the frame end, there is a probability that the cushion tip itself will have been damaged by ripping or rupturing of the tip.

Referring now to FIGS. 4 and 5, the cushion tip 20 is provided on the end of the frame 10 or 12 by inserting the end of the frame into a molding die, and then injection molding the cushion tip by employing conventional injection molding techniques.

As the plastics material is in a fluid state at the time it is injection molded onto the frame 10 or 12, it is free to flow through any intesticies that have been provided in the frame end, and also, it is free to self-adhere to all of the exposed surfaces of the end of the frame that are presented interiorly of the mold. Thus, the possibility of the cushion tip being accidentally removed from the frame tip during use is greatly reduced, while at the same time possible damage to the tip such as occurs in the prior art constructions are eliminated in the entirety.

A further advantage resulting from the present invention is that the frame itself acts as a heat sink for the molten plastics material employed in the injection molding process. The use of the frame as a heat sink is a "single-use" only. Thus, the tips can be set and removed from the mold in a much shorter time than is required in the separate molding of the tips process, which requires not only chilling of the mold, but also chilling of the core member employed to provide the frame receiving socket in the tip.

As shown in FIG. 5, the end of the frame, which is of a second cross-sectional area, is provided with a tang 22, which easily can be provided by a punching operation effected prior to the enrobement of the frame end with the cushion tip material. Further, during that punching operation the flat surface of the width of the frame can be roughened, as indicated at 24, or, be provided with lateral striations, indicated at 26 to further enhance the adhesion of the cushion tip material in its molten form to the outer surfaces of the frame end.

The resultant cushion tip then has a third cross-sectional area including a width that is identical to the width of the frame 10 or 12, and, has a thickness which only slightly exceeds the thickness of the frame 10 or 12 by an amount sufficient to provide a retaining skin overlying the opposed faces of the tang 22.

As illustrated in FIG. 6, the option exists of pre-punching the tang 22 with apertures 28 or through-holes 30, which become flooded with the molten plastics material during the injection molding of that material, thus to provide further reinforcement militating against removal of the tip 20 from the frame end 10 or 12.

The slight increase in thickness of the cushion tip 20 as related to the thickness of the frame 10 or 12 can be eliminated, as is illustrated in FIG. 7.

In FIG. 7, a tang 30 has been pre-formed on the end of the frame 10 or 12 by a drop stamping or forging operation, as is well-known in the art, the tang 30 having a thickness that is less than the thickness of the frame 10 or 12, in this manner permitting the tang 30 to be enrobed with the plastics material of the cushion tip 20, while at the same time permitting the cushion tip 20 to be of no greater thickness than the thickness of the frame 10 or 12.

The mechanical formation of the ends of the brassiere frames is well-known to persons skilled in the art, as is the injection molding of the cushion tips onto the pre-formed ends of the frames.

The pre-formation of the ends of the frames does not represent an added cost over the prior art. The prior art also requires pre-formation of the frame ends in order to provide barbs or other securements operative to retain the cushion tip 14 in position subsequent to its being forced over the end of the frame 10 or 12.

What we claim is:

1. A brassiere frame comprised of a length of metal of a first pre-determined cross-sectional area, wherein the cross-sectional area along the brassiere frame is the width multiplied by the thickness;

a portion of said length of metal at its free ends being of a second cross-sectional area which is less than said first cross-sectional area of the remainder of said metal strip, and of a lesser width than the remainder of said metal strip; and a molding of plastics material, of a third cross-sectional area surrounding said second cross-sectional portion of said length of metal at each of said free ends to provide a cushion tip for said brassiere frame at each of said free ends;

the width of said third cross-sectional area of said cushion tip being no greater than the width of said first cross-sectional area; and the plastic material forming said cushion tip having a thickness substantially less than the thickness of said first and second cross-sectional areas, wherein the cross-sectional area of said brassiere frame along its entire extent, including said cushion tips, does not exceed the width of said first cross-sectional area, and is substantially less than three times the thickness of said first cross-sectional area.

2. The brassiere frame of claim 1, in which said end portion of said frame of said second lesser cross-section area includes re-entrant portions for securing said tip against removal from said end portion of reduced cross-section.

3. The brassiere frame of claim 1 in which the width of said second cross-sectional areas at said free end portions of said frame is of lesser width than said first cross-sectional area of the adjacent portion of said frame.

4. The brassiere frame of claim 1 in which said second cross-sectional area at said the free end of said metal strip is of lesser width and also of lesser thickness than the width and thickness of said first cross-sectional area at the adjacent portion of said metal strip.

5. The brassiere frame of claim 1, further including a barb providing said free end of said metal strip, and which includes re-entrant surfaces for securing said molded tip of plastics material.

6. The brassiere frame of claim 1, in which said free end of said metal strip includes apertures extending through the thickness of said strip, said molding of plastics material extending into said apertures, and further acting to secure said cushion tip against removal from the free end of said metal strip.

7. The brassiere frame of claim 1, in which said free end of said metal strip has surface roughenings.

8. The brassiere frame of claim 1 in which all of said first, second and third cross-sectional areas are rectangular.

9. The brassiere frame of claim 8 in which the thickness of said second cross-sectional area is less than the thickness of said first cross-sectional area, and the thickness of said brassiere frame along its entire extent, including said cushion tips, does not exceed the thickness of said first cross-sectional area.

10. A brassiere frame comprised of a length of metal of a first pre-determined cross-sectional area, wherein the cross-sectional area along the brassiere frame is the width multiplied by the thickness;

a portion of said length of metal at its free ends being of a second cross-sectional area which is less than said first cross-sectional area of the remainder of said metal strip, and of a lesser width than the remainder of said metal strip; and a molding of plastics material, of a third cross-sectional area surrounding said second cross-sectional portion of said length of metal at each of said free ends to provide a cushion tip for said brassiere frame at each of said free ends;

the width of said third cross-sectional area of said cushion tip being no greater than the width of said first cross-sectional area; and the plastic material forming said cushion tip having a thickness substantially less than the thickness of said first and second cross-sectional areas, wherein the cross-sectional area of said brassiere frame along its entire extent, including said cushion tips, does not exceed the width of said first cross-sectional area, and is no more than slightly greater than the thickness of said first cross-sectional area.

* * * * *